US005528970A

United States Patent [19]

Zacaroli

[11] Patent Number: 5,528,970

[45] Date of Patent: Jun. 25, 1996

[54] TONE CONTROL FOR STRINGED MUSICAL INSTRUMENT

[76] Inventor: Edward C. Zacaroli, 122 Arlington Rd., Utica, N.Y. 13501

[21] Appl. No.: 374,829

[22] Filed: Jan. 19, 1995

[51] Int. Cl.[6] ..... G10D 3/14

[52] U.S. Cl. ..... 84/312 R; 84/200; 84/455

[58] Field of Search ..... 84/312 R, 454, 84/455, DIG. 18

[56] References Cited

U.S. PATENT DOCUMENTS

| | | | |
|---|---|---|---|
| 2,624,027 | 12/1952 | Clark | 318/29 |
| 4,044,239 | 8/1977 | Shimauchi et al. | 84/DIG. 18 |
| 4,077,298 | 3/1978 | Kondo | 84/454 |
| 4,207,791 | 6/1980 | Murakami | 84/454 |
| 4,271,746 | 6/1981 | Dobbie | 84/454 |
| 4,375,180 | 3/1983 | Scholz | 84/454 |
| 4,426,907 | 1/1984 | Scholz | 84/454 |
| 4,453,448 | 6/1984 | Miesak | 84/454 |
| 4,803,908 | 2/1989 | Skinn et al. | 84/454 |
| 4,829,843 | 5/1989 | Suzuki | 74/470 |
| 4,889,029 | 12/1989 | St. Denis | 84/454 |
| 4,909,126 | 3/1990 | Skinn et al. | 84/454 |
| 4,928,563 | 5/1990 | Murata et al. | 84/454 |
| 5,095,797 | 3/1992 | Zacaroli | 84/DIG. 18 |

*Primary Examiner*—Patrick J. Stanzione
*Attorney, Agent, or Firm*—Harris Beach & Wilcox

[57] ABSTRACT

A musical pitch control for each of the strings on a musical instrument. A pivot arm is secured to one end of each string. Controlled current is applied to a length of memory wire secured between the arm and an anchor point. The bending strain on the arm is sensed and circuitry responsive to the sensor is arranged to rock the arm to maintain a desired tension on the string. A second biasing device also acts upon the arm in opposition to the alloy wire to urge the wire alloy to return to its original condition when no current is flowing through the memory wire.

17 Claims, 6 Drawing Sheets

TONE CONTROL FOR STRINGED MUSICAL INSTRUMENT

BACKGROUND OF THE INVENTION

1. Field of the Invention

This invention relates generally to automatically controlled musical instruments and specifically to a musical pitch control apparatus for each of a plurality of musical strings of a stringed musical instrument.

2. Discussion of the Related Art

A number of proposals for automatic tuning devices appear in the literature, but these have not been widely accepted. Clark U.S. Pat. No. 2,624,027 employs a motor control system to tension a vibrating filament. Scholz U.S. Pats. Nos. 4,375,180 and 4,426,907 describe an automatic self-tuning device for guitars, using electrical contacts that make or break to energize an electric motor that controls the string tension. Skinn et al. U.S. Pat. No. 4,803,908 describes a digital tuning system in which each string of a guitar has an associated tuning arm and stepper motor. A transducer senses the pitch of the vibrating strings and adjusts the string tensions accordingly. Murata et al. U.S. Pat. No. 4,928,563 relates to an electronic tuning apparatus for electric guitars in which pitch information is extracted from the instrument during playing, and a small motor is energized for each string to adjust the string tension.

Zacaroli U.S. Pat. No. 5,095,797 discloses an automatic tuning control arrangement for a stringed musical instrument comprising a pivoted tone arm, a pivot, a length memory metal alloy wire traction motor, a strain sensor means, a current driving circuit, and a biasing means for applying a spring bias in opposition to the musical string tension. Several improvements to Zacaroli '797 have been made: the spring bias is applied in a direction that opposes a shortening of the alloy wire, a specific embodiment of the current driving circuit is disclosed, a lamp indicating a pitch threshold is taught, a shut-down safety feature is incorporated to deactivate one of the current driving circuits in the event that the associated musical string breaks, and a plurality of pulleys are utilized to reduce an area occupied by the apparatus.

OBJECTS AND SUMMARY OF THE INVENTION

It is therefore an object of the present invention to improve musical pitch control apparatuses for stringed musical instruments.

It is a further object of the present invention to apply a biasing means in a direction that opposes the shortening of the length memory metal alloy wire to encourage the wire to return to its original length when no current is driven to the alloy wire.

A still further object of the present invention is to disclose a specific embodiment of a variable current driving circuit.

Another object of the present invention is to provide a lamp indicating a pitch threshold.

Still another object of the present invention is to provide a shutdown safety feature to deactivate one of the current driving circuits in the event that the associated musical string breaks.

Yet another object of the present invention is to utilize a plurality of pulleys to reduce the area occupied by the apparatus.

These and other objects of the present invention are attained by providing a musical pitch control apparatus for each of a plurality of musical strings of a stringed musical instrument including: a pivoted arm, a first biasing means, a second biasing means, a strain sensor means, a variable current driving circuit, an improvement of the second biasing means, and an improvement of the variable current driving circuit. The pivoted arm has a means for securing a first end of the associated musical string. The first biasing means biases the arm in a direction to increase the tension on the musical string and is comprised of a length memory alloy wire secured between the arm and a wire anchor. The second biasing means biases the direction in which the arm rocks. The strain sensor means detects an effective tension on the musical string by sensing a bending strain on the arm. The variable current driving circuit has an input coupled to the strain sensor means and an output connected to the alloy wire for driving a current through the alloy wire that varies as a function of the strain on the arm to variably shorten the wire, thus causing the alloy wire to rock the arm and maintain the tension on the string at a constant. The improved second biasing means biases the arm in a direction that opposes a shortening of said alloy wire of said first biasing means to encourage the alloy wire to return to an original length when no current is driven to the alloy wire. The improved variable current driving circuit includes: a bridge circuit, a comparator circuit, an amplifier circuit, and a pulse width modulating circuit. The bridge circuit has the strain sensor means connected in two legs thereof. The comparator circuit compares a strain sensor voltage with a bridge reference voltage and produces a variable voltage output. The amplifier circuit has an amplifier output which activates both the pulse width modulating circuit and the indicator lamp, such that when the indicator lamp is activated, the pulse width modulating circuit is deactivated and when the lamp is deactivated, the circuit is activated. The amplifier input is coupled to the voltage output of the comparator circuit, whereby a musical pitch threshold is indicated. The pulse width modulating circuit variably drives a current to the alloy wire and has a variable input coupled to the voltage output of the comparator circuit.

Another aspect of the invention is to illuminate the indicator lamp when the musical pitch of the associated string is less than the pitch threshold value and the lamp turns off once an associated tuning machine, secured to a second end of the string, is manually turned to increase the pitch of the string above the threshold value. An ON/OFF enable input of the pulse width modulating circuit is coupled to the amplifier output to activate the pulse width modulating circuit once the musical pitch threshold has been attained. Additionally, in the event a musical string breaks, the associated current driving circuit is deactivated.

Still another aspect of the invention is to provide the first biasing means comprised of a plurality of pulleys around which the alloy wire is wrapped to reduce an area occupied by the apparatus. Additionally, the first biasing means is comprised of a first of the pulleys anchored to the arm, a second of the pulleys anchored to a first of the pulley anchors, a third of the pulleys anchored to a second of the pulley anchors, a first end of the alloy wire anchored to a first of the wire anchors, and a second end of the alloy wire is anchored to a second of the wire anchors.

BRIEF DESCRIPTION OF THE DRAWINGS

For a fuller understanding of the nature and objects of the invention, reference should be made to the following detailed description read in connection with the accompanying drawings, in which.

DETAILED DESCRIPTION OF THE INVENTION

Figure 1:
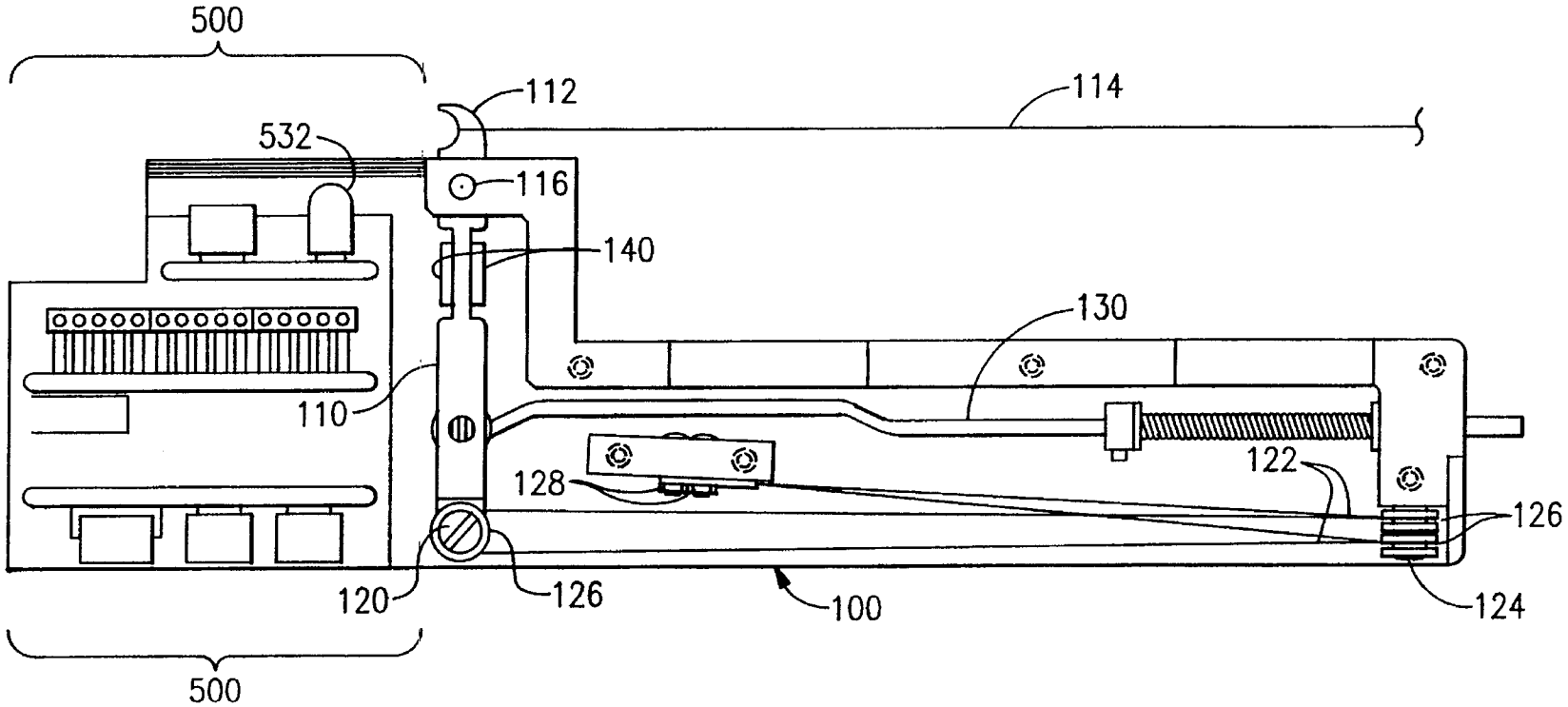
FIG. 1 is a cross-sectional view of the musical pitch control apparatus for one of the plurality of musical strings.

Referring initially to FIG. 1, there is shown a cross-sectional view of the musical pitch control apparatus, generally referenced 100, for one of the plurality of strings 114. The pivoted arm 110, having means for securing 112 the first end of the associated musical string 114, rocks about pivot 116. The first biasing means 120, for biasing the arm 110 in a direction to increase the tension on the musical string 114, is comprised of the length memory alloy wire 122 anchored at each end to wire anchors 128 and wrapped around the pulleys 126 to reduce the area occupied by the apparatus 100. Two pulleys 126 are anchored to the pulley anchor 124 and the third pulley 126 is anchored to the arm 110. The second biasing means 130 biases the arm 110 in a direction that opposes a shortening of the alloy wire 122 to encourage the alloy wire 122 to return to an original length when no current is driven to the alloy wire 122.

Figure 5:
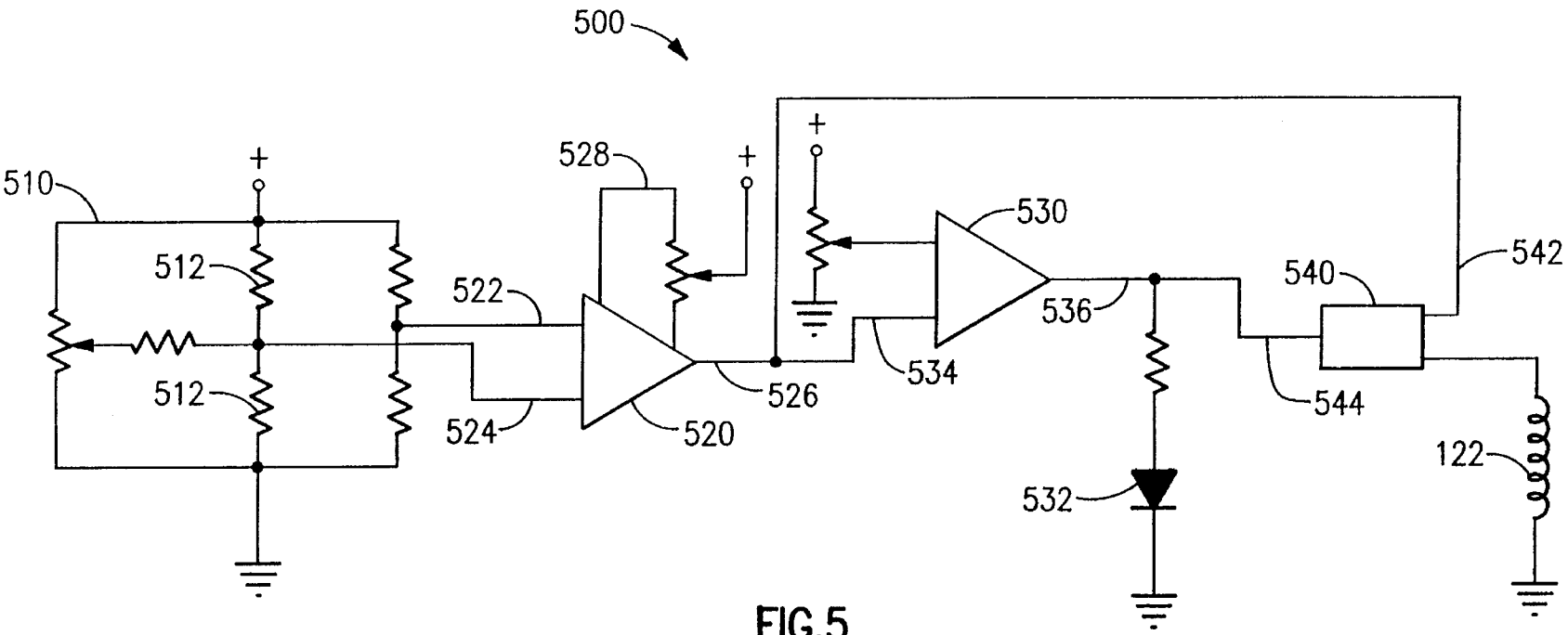
FIG. 5 is a schematic of the variable current driving circuit.

The strain sensing means 140 detects an effective tension on the musical string 114 by sensing a bending strain on the arm 110. The variable current driving circuit, generally referenced 500, occupies the entire left end of the apparatus 100 depicted in FIG. 1. The lamp 532 illuminates when the musical pitch of the associated string 114 is less than the pitch threshold. Refer to FIG. 5 for a more detailed description of the circuit 500.

Figure 2:
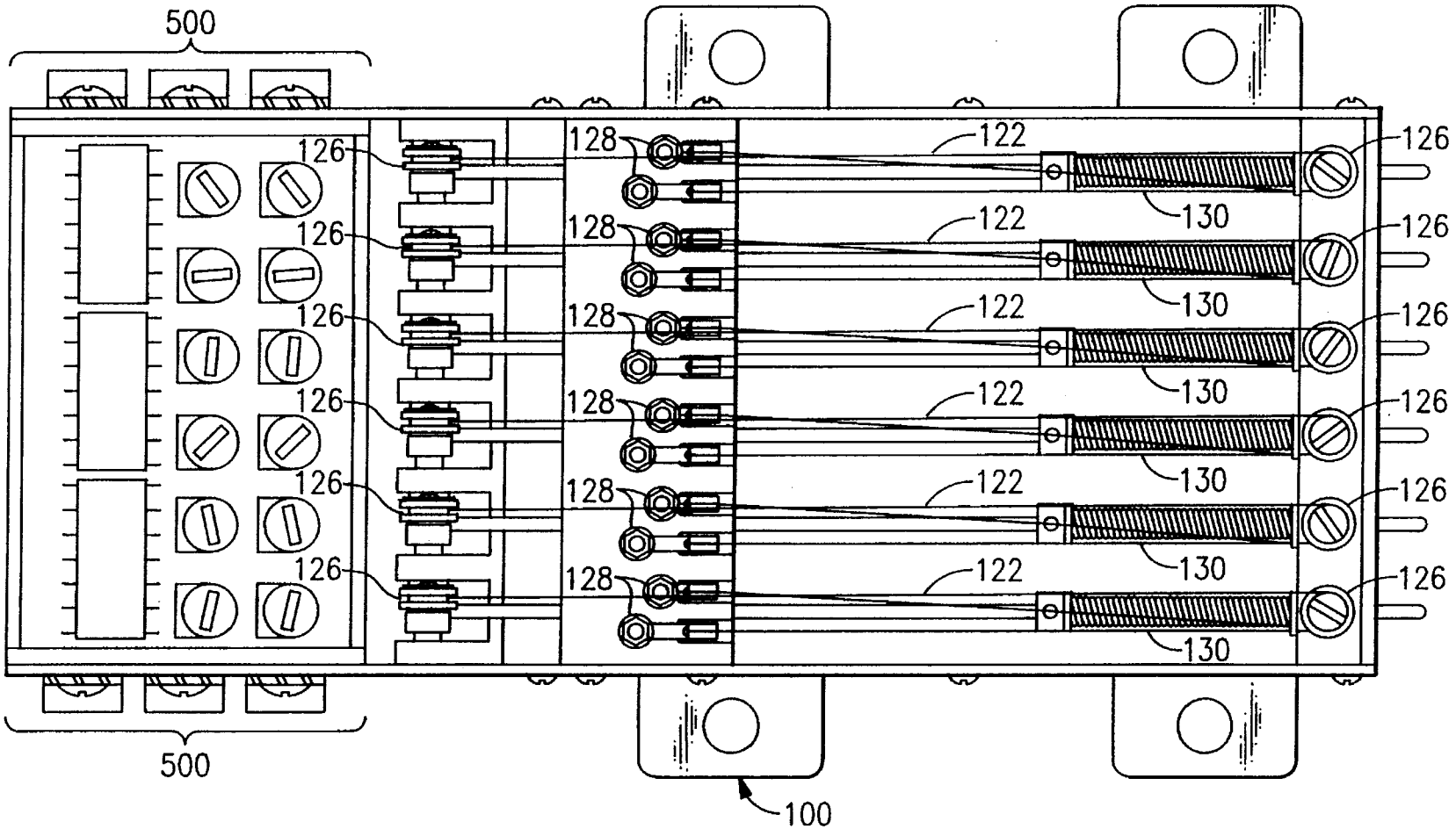
FIG. 2 is a plan view of the musical pitch control apparatus without a cover plate for six musical strings.

In FIG. 2 there is shown a plan view of the apparatus, generally referenced 100, without a cover plate for six musical strings 114. Also shown are six sets of pulleys 126, six sets of wire anchors 128, six second biasing means 130, and the variable current driving circuit 500, which occupies the left end of the apparatus 100.

Figure 3:
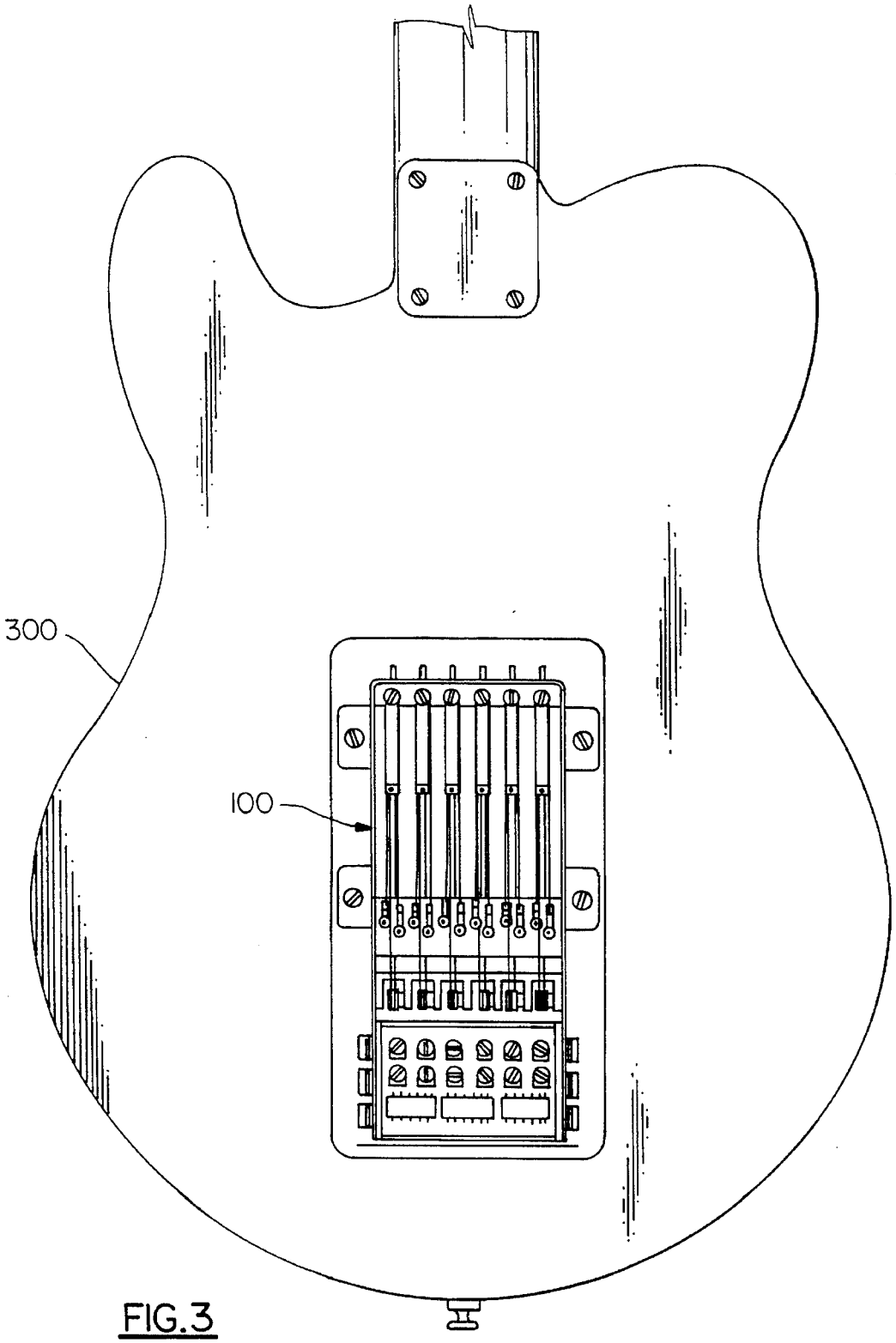
FIG. 3 is a rear view of a guitar body with the apparatus integrated therein.

In FIG. 3 there is shown a rear view of a guitar body, generally referenced 300, with the apparatus 100 integrated therein.

Figure 4:
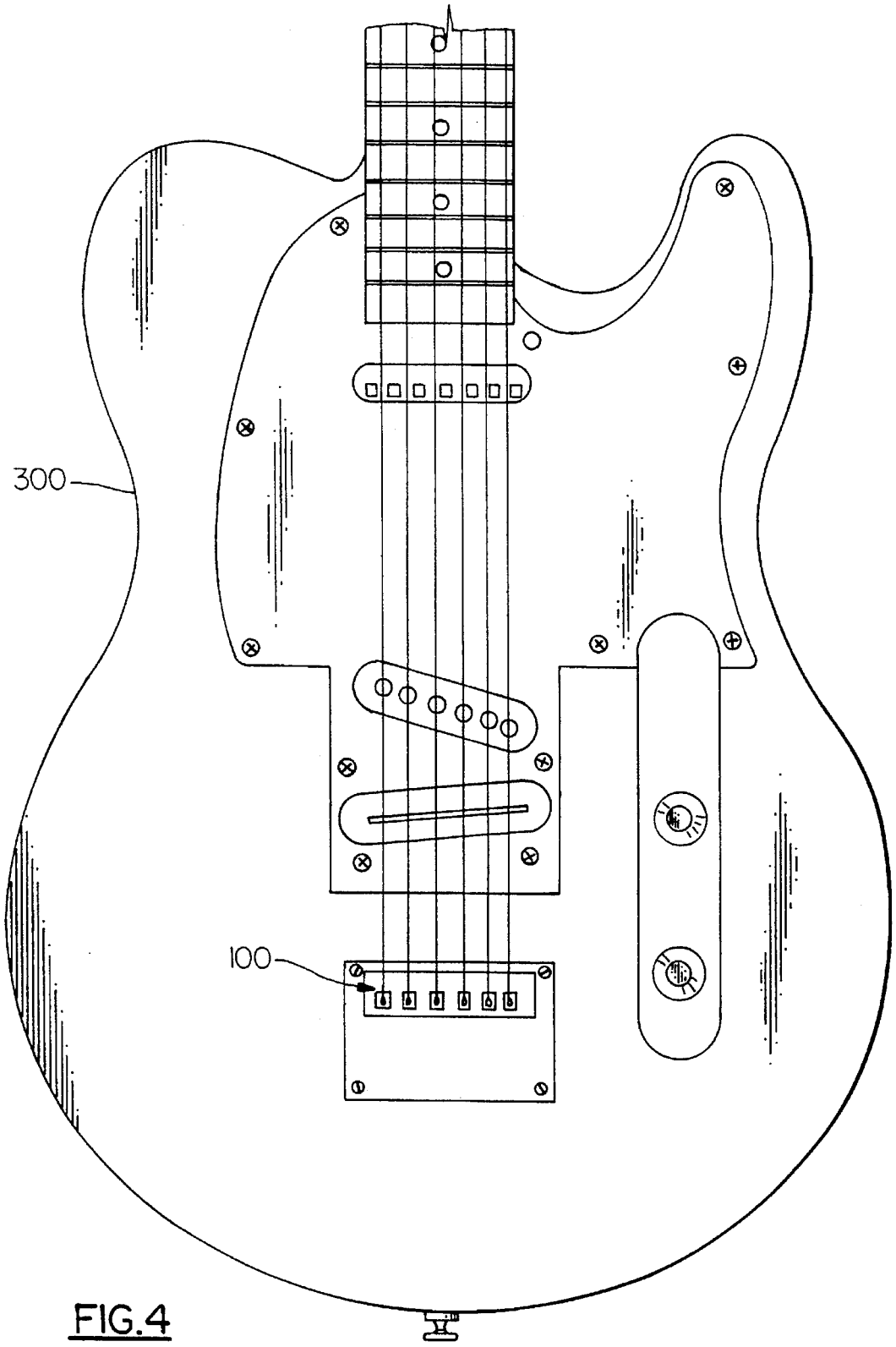
FIG. 4 is a front view of a guitar body with the apparatus integrated therein.

In FIG. 4 there is shown a front view of a guitar body, generally referenced 300, with the apparatus 100 integrated therein.

In FIG. 5 there is shown a schematic of the variable current driving circuit, generally referenced 500. The variable current driving circuit 500 drives a current through the alloy wire 122 that varies as a function of the strain on the arm 110 to shorten the length of the alloy wire 122, thus causing the alloy wire 122 to rock the arm 110 and maintain the tension on the musical string 114 at a constant. The bridge circuit 510 has the strain sensor means 512 connected in two legs thereof. The comparator circuit 520 compares a strain sensor voltage 522 with a bridge reference voltage 524 and produces a variable voltage output 526. The amplifier circuit 530 has an amplifier output 536 which activates both the pulse width modulating circuit 540 and the indicator lamp 532, such that when the indicator lamp 532 is activated, the pulse width modulating circuit 540 is deactivated, and when the lamp 532 is deactivated, the circuit 540 is activated. The amplifier input 534 is coupled to the voltage output 526 of the comparator circuit 520, whereby a musical pitch threshold is indicated. The pulse width modulating circuit 540 variably drives a current to the alloy wire 122 and has a variable input 542 coupled to the voltage output 526 of the comparator circuit 520.

The indicator lamp 532 is illuminated when the musical pitch of the associated string 114 is less than the pitch threshold value and the lamp 532 is deactivated once an associated tuning machine 610 (refer to FIG. 6), secured to a second end of the musical string 114, is manually turned to increase the pitch of the string 114 above the threshold value. The ON/OFF enable input 544 of the pulse width modulating circuit 540 is coupled to the amplifier output 536 to activate the pulse width modulating circuit 540 once the musical pitch threshold has been attained. Additionally, in the event a musical string breaks, the associated current driving circuit is deactivated.

Figure 6:
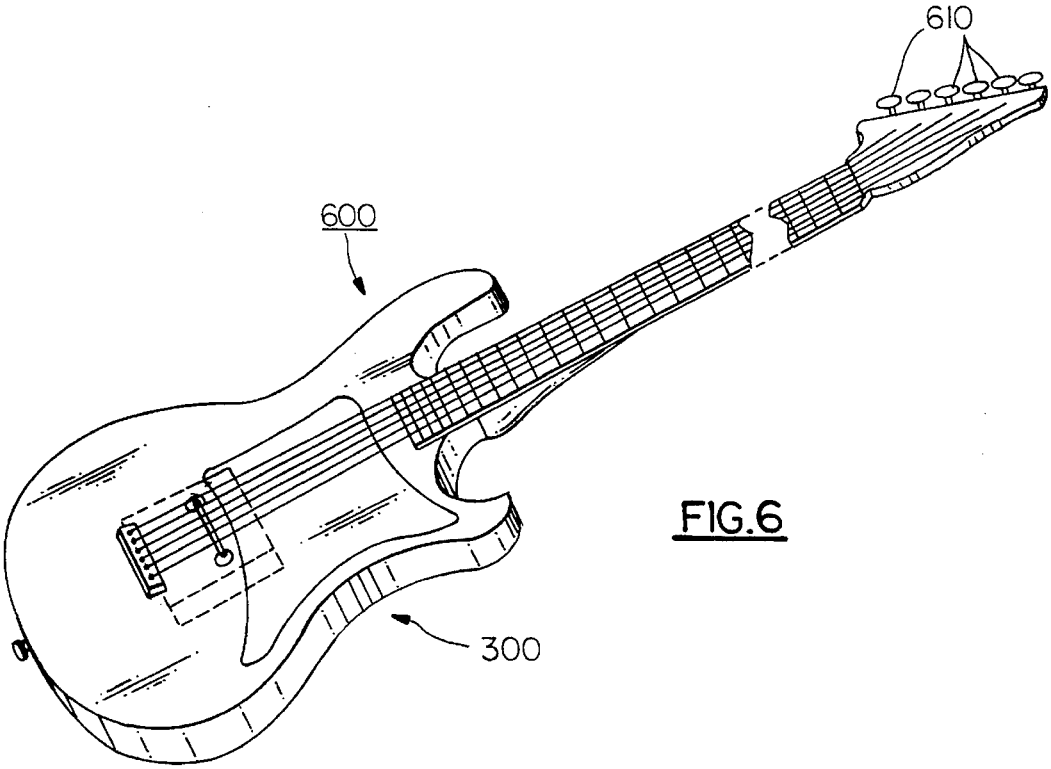
FIG. 6 is a perspective view of a guitar.

In FIG. 6 there is shown a perspective view of a guitar, generally referenced 600, and six tuning machines 610.

While this invention has been explained with reference to the structure disclosed herein, it is not confined to the details as set forth and this application is intended to cover any modifications and changes as may come within the scope of the following claims.

What is claimed is:

1. A musical pitch control apparatus for each of a plurality of musical strings of a stringed musical instrument including: a pivoted arm having means for securing a first end of the associated musical string; a first biasing means, for biasing said arm in a direction to increase the tension on the musical string, comprised of a length memory alloy wire secured between said arm and a wire anchor; a strain sensor means for detecting an effective tension on the musical string by sensing a bending strain on said arm; and a variable current driving circuit having an input coupled to said strain sensor means and an output connected to said alloy wire for driving a current through said alloy wire that varies as a function of the strain on said arm to adjustably shorten said alloy wire, thus causing said alloy wire to rock said arm and maintain the tension on the string at a constant; wherein the improvement comprises:

a second biasing means biasing said arm in a direction that opposes a shortening of said alloy wire of said first biasing means to encourage said alloy wire to return to an original length when no current is driven to said alloy wire;

a current driving circuit including a bridge circuit having said strain sensor means connected into two legs thereof; a comparator circuit for comparing a strain sensor voltage with a bridge reference voltage and producing a variable voltage output; a fine tone adjuster circuit for modifying the relation between the strain sensor voltage and the bridge reference voltage at said comparator circuit; an amplifier circuit for activating an indicator lamp and a pulse width modulating circuit, and having an amplifier input coupled to the voltage output of said comparator circuit, whereby a musical pitch threshold is indicated; and said pulse width modulating circuit for variably driving a current to said alloy wire and having a variable input coupled to the voltage output of said comparator circuit.

2. The apparatus of claim 1, wherein said lamp illuminates when the musical pitch of the associated string is less than the pitch threshold value and said lamp is deactivated once an associated tuning machine, secured to a second end of the string, is manually turned to increase the pitch of the string above the threshold value.

3. The apparatus of claim 2, wherein said pulse width modulating circuit is not activated until said lamp is deactivated and the pitch of the string is above the threshold value.

4. The apparatus of claim 3, wherein said current driving circuit is deactivated when the associated musical string breaks.

5. The apparatus of claim 4, wherein said first biasing means is further comprised of a plurality of pulley anchors anchoring a plurality of pulleys around which said alloy wire is wrapped to reduce an area occupied by said apparatus.

6. The apparatus of claim 5, wherein said first biasing means is further comprised of a first of said pulleys anchored to said arm, a second of said pulleys anchored to a first of said pulley anchors, a third of said pulleys anchored to a second of said pulley anchors, a first end of said alloy wire anchored to a first of said wire anchors, and a second end of said alloy wire is anchored to a second of said wire anchors.

7. A musical pitch control apparatus for each of a plurality of musical strings of a stringed musical instrument including: a pivoted arm having means for securing a first end of the associated musical string; a first biasing means, for biasing said arm in a direction to increase the tension on the musical string, comprised of a length memory alloy wire secured between said arm and a wire anchor; a second biasing means for biasing the direction in which said arm rocks; a strain sensor means for detecting an effective tension on the musical string by sensing a bending strain on said arm; and a variable current driving circuit having an input coupled to said strain sensor means and an output connected to said alloy wire for driving a current through said alloy wire that varies as a function of the strain on said arm to adjustably shorten said alloy wire, thus causing said alloy wire to rock said arm and maintain the tension on the string at a constant; wherein the improvement comprises:

said current driving circuit further including:

a bridge circuit having said strain sensor means connected in two legs thereof;

a comparator circuit for comparing a strain sensor voltage with a bridge reference voltage and producing a variable voltage output;

an amplifier circuit for activating an indicator lamp and a pulse width modulating circuit, and having an amplifier input coupled to the voltage output of said comparator circuit, whereby a musical pitch threshold is indicated; and said pulse width modulating circuit for variably driving a current to said alloy wire and having alloy wire and having a variable input coupled to the voltage output of said comparator circuit.

8. The apparatus of claim 7, wherein said lamp illuminates when the musical pitch of the associated string is less than the pitch threshold value and said lamp is deactivated once an associated tuning machine, secured to a second end of the string, is manually turned to increase the pitch of the string above the threshold value.

9. The apparatus of claim 8, wherein said pulse width modulating circuit is not activated until said lamp is deactivated and the pitch of the string is above the threshold value.

10. The apparatus of claim 9, wherein said current driving circuit is deactivated when the associated musical string breaks.

11. The apparatus of claim 10, wherein said second biasing means biases said arm in a direction that opposes a shortening of said alloy wire of said first biasing means to encourage said alloy wire to return to an original length when no current is driven to said alloy wire.

12. The apparatus of claim 11, wherein said first biasing means is further comprised of a plurality of pulley anchors anchoring a plurality of pulleys around which said alloy wire is wrapped to reduce an area occupied by said apparatus.

13. The apparatus of claim 12, wherein said first biasing means is further comprised of a first of said pulleys anchored to said arm, a second of said pulleys anchored to a first of said pulley anchors, a third of said pulleys anchored to a second of said pulley anchors, a first end of said alloy wire anchored to a first of said wire anchors, and a second end of said alloy wire is anchored to a second of said wire anchors.

14. The apparatus of claim 13, wherein said first biasing means is further comprised of a plurality of pulley anchors anchoring a plurality of pulleys around which said alloy wire is wrapped to reduce an area occupied by said apparatus.

15. The apparatus of claim 14, wherein said first biasing means is further comprised of a first of said pulleys anchored to said arm, a second of said pulleys anchored to a first of said pulley anchors, a third of said pulleys anchored to a second of said pulley anchors, a first end of said alloy wire anchored to a first of said wire anchors, and a second end of said alloy wire anchored to a second of said wire anchors.

16. A musical pitch control apparatus for each of a plurality of musical strings of a stringed musical instrument including: a pivoted arm having means for securing a first end of the associated musical string; a first biasing means, for biasing said arm in a direction to increase the tension on the musical string; a strain sensor means for detecting an effective tension on the musical string by sensing a bending strain on said arm; and a variable current driving circuit having an input coupled to said strain sensor means and an output connected to said alloy wire for driving a current through said alloy wire that varies as a function of the strain on said arm to adjustably shorten said alloy wire, thus causing said alloy wire to rock said arm and maintain the tension on the string at a constant; wherein the improvement comprises:

said first biasing means is further comprised of a plurality of pulley anchors anchoring a plurality of pulleys around which said alloy wire is wrapped to reduce an area occupied by said apparatus;

a second biasing means biasing said arm in a direction that opposes a shortening of said alloy wire of said first biasing means to encourage said alloy wire to return to an original length when no current is driven to said alloy wire.

17. The apparatus of claim 16, wherein said first biasing means is further comprised of a first of said pulleys anchored to said arm, a second of said pulleys anchored to a first of said pulley anchors, a first end of said alloy wire anchored to a first of said wire anchors, and a second end of said alloy wire anchored to a second of said wire anchors.

* * * * *